US009206551B2

(12) United States Patent
Esser

(10) Patent No.: US 9,206,551 B2
(45) Date of Patent: Dec. 8, 2015

(54) METHOD FOR PRODUCING PAPER, PAPERBOARD AND CARDBOARD HAVING HIGH DRY STRENGTH

(71) Applicant: BASF SE, Ludwigshafen (DE)

(72) Inventor: Anton Esser, Limburgerhof (DE)

(73) Assignee: BASF SE, Ludwigshafen (DE)

( * ) Notice: Subject to any disclaimer, the term of this patent is extended or adjusted under 35 U.S.C. 154(b) by 0 days.

(21) Appl. No.: 14/105,259

(22) Filed: Dec. 13, 2013

(65) Prior Publication Data

US 2014/0102649 A1 Apr. 17, 2014

Related U.S. Application Data

(63) Continuation of application No. 13/502,885, filed as application No. PCT/EP2010/065375 on Oct. 14, 2010, now Pat. No. 8,647,470.

(30) Foreign Application Priority Data

Oct. 20, 2009 (EP) ..... 09173497

(51) Int. Cl.

| | |
|---|---|
| ***D21H 17/25*** | (2006.01) |
| ***D21H 17/45*** | (2006.01) |
| ***D21H 21/18*** | (2006.01) |
| ***D21H 17/37*** | (2006.01) |
| ***D21H 17/42*** | (2006.01) |
| ***D21H 17/44*** | (2006.01) |

(52) U.S. Cl.

CPC ..... *D21H 17/37* (2013.01); *D21H 17/42* (2013.01); *D21H 17/44* (2013.01); *D21H 21/18* (2013.01)

(58) Field of Classification Search

CPC ..... D21H 11/16; D21H 11/18; D21H 11/20; D21H 11/22; D21H 21/10; D21H 21/20; D21H 17/42; D21H 17/43; D21H 17/44; D21H 17/45; D21H 17/25; D21H 17/455; D21H 21/18; B82Y 30/00; C08L 1/00; C08L 1/02; C08L 1/04

USPC ..... 162/146, 157.6, 157.7, 168.1, 168.2, 162/168.3, 182, 185, 187, 183, 175–177; 977/762, 788, 895, 896, 961, 963

See application file for complete search history.

(56) References Cited

U.S. PATENT DOCUMENTS

| | | | | |
|---|---|---|---|---|
| 6,602,994 | B1 * | 8/2003 | Cash et al. | 536/30 |
| 6,824,599 | B2 * | 11/2004 | Swatloski et al. | 106/163.01 |
| 2004/0140074 | A1 * | 7/2004 | Tokarz et al. | 162/181.8 |
| 2007/0181274 | A1 * | 8/2007 | Esser et al. | 162/168.2 |
| 2008/0265222 | A1 | 10/2008 | Ozersky et al. | |
| 2009/0020248 | A1 | 1/2009 | Sumnicht et al. | |
| 2011/0048660 | A1 | 3/2011 | Esser et al. | |
| 2011/0079365 | A1 | 4/2011 | Haehnle et al. | |
| 2011/0088860 | A1 * | 4/2011 | Heijnesson-Hulten et al. | 162/164.1 |
| 2011/0100575 | A1 | 5/2011 | Schmidt-Thuemmes et al. | |
| 2011/0108226 | A1 | 5/2011 | Schmidt-Thuemmes et al. | |
| 2011/0230601 | A1 | 9/2011 | Nieberle et al. | |
| 2011/0308752 | A1 | 12/2011 | Esser et al. | |
| 2012/0080156 | A1 * | 4/2012 | Laleg et al. | 162/158 |
| 2012/0132383 | A1 * | 5/2012 | Laine et al. | 162/175 |
| 2012/0227920 | A1 * | 9/2012 | Juppo et al. | 162/164.6 |

FOREIGN PATENT DOCUMENTS

| | | | |
|---|---|---|---|
| CN | 1335856 | A | 2/2002 |
| DE | 35 06 832 | | 8/1986 |
| EP | 0 438 744 | | 7/1991 |
| WO | WO 00/47628 | A2 | 8/2000 |
| WO | WO 00/47628 | A3 | 8/2000 |
| WO | 01 36500 | | 5/2001 |
| WO | 03 029329 | | 4/2003 |
| WO | 2004 061235 | | 7/2004 |
| WO | 2006 048280 | | 5/2006 |
| WO | 2006 056381 | | 6/2006 |
| WO | 2007 091942 | | 8/2007 |
| WO | 2009 038730 | | 3/2009 |
| WO | 2009 043860 | | 4/2009 |
| WO | 2009 080613 | | 7/2009 |

OTHER PUBLICATIONS

International Search Report Issued Mar. 1, 2011 in PCT/EP10/65375 Filed Oct. 14, 2010.

* cited by examiner

*Primary Examiner* — Eric Hug

(74) *Attorney, Agent, or Firm* — Oblon, McClelland, Maier & Neustadt, L.L.P.

(57) ABSTRACT

Process for the production of paper, board and cardboard having high dry strength by addition of an aqueous composition comprising a nanocellulose and at least one polymer selected from the group consisting of the anionic polymers and water-soluble cationic polymers, draining of the paper stock and drying of the paper products.

8 Claims, No Drawings

METHOD FOR PRODUCING PAPER, PAPERBOARD AND CARDBOARD HAVING HIGH DRY STRENGTH

CROSS REFERENCE TO RELATED APPLICATION(S)

This application is a continuation of U.S. application Ser. No. 13/502,885, filed on Apr. 19, 2012, the entire content of which is incorporated herein by reference.

DESCRIPTION

The invention relates to a process for the production of paper, board and cardboard having high dry strength by addition of an aqueous composition comprising a nanocellulose and at least one polymer selected from the group consisting of the anionic polymers and water-soluble cationic polymers, draining of the paper stock and drying of the paper products.

In order to increase the dry strength of paper, a dry strength agent can either be applied to the surface of already dried paper or added to a paper stock prior to sheet formation. The dry strength agents are usually used in the form of a 1 to 10% strength aqueous solution. If such a solution of a dry strength agent is applied to the surface of paper, considerable amounts of water must be evaporated in the subsequent drying process. Since the drying step is very energy-intensive and since the capacity of the customary drying apparatuses on paper machines is in general not so large that it is possible to operate at the maximum possible production speed of the paper machine, the production speed of the paper machine must be reduced in order for the paper treated with the dry strength agent to be dried to a sufficient extent.

If, on the other hand, the dry strength agent is added to a paper stock prior to the sheet formation, the treated paper may be dried only once. DE 35 06 832 A1 discloses a process for the production of paper having high dry strength, in which first a water-soluble cationic polymer and then water-soluble anionic polymer are added to the paper stock. In the examples, polyethyleneimine, polyvinylamine, polydiallyldimethylammonium chloride and epichlorohydrin crosslinked condensates of adipic acid and diethylenetriamine are described as water-soluble cationic polymers. For example homo- or copolymers of ethylenically unsaturated $C_3$- to $C_5$-carboxylic acids are suitable as water-soluble anionic polymers. The copolymers comprise, for example, from 35 to 99% by weight of an ethylenically unsaturated $C_3$- to $C_5$-carboxylic acid, such as, for example, acrylic acid.

WO 04/061235 A1 discloses a process for the production of paper, in particular tissue, having particularly high wet and/or dry strengths, in which first a water-soluble cationic polymer which comprises at least 1.5 meq of primary amino functionalities per g of polymer and has a molecular weight of least 10 000 dalton is added to the paper stock. Particularly singled out here are partly and completely hydrolyzed homopolymers of N-vinylformamide. Thereafter, a water-soluble anionic polymer which comprises anionic and/or aldehydic groups is added. Especially the variability of the two-component systems described, with regard to various paper properties, including wet and dry strength, is emphasized as an advantage of this process.

WO 06/056381 A1 discloses a process for the production of paper, board and cardboard having high dry strength a separate addition of a water-soluble polymer comprising vinylamine units and of a water-soluble polymeric anionic compound to a paper stock, draining of the paper stock and drying of the paper products, the polymeric anionic compound used being at least one water-soluble copolymer which is obtainable by copolymerization of at least one N-vinylcarboxamide of the formula (I)

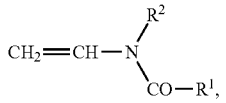

(I)

where $R^1$, $R^2$ are H or $C_1$- to $C_6$-alkyl, at least one monoethylenically unsaturated monomer comprising acid groups and/or the alkali metal, alkaline earth metal or ammonium salts thereof and, optionally, other monoethylenically unsaturated monomers and, optionally, compounds which have at least two ethylenically unsaturated double bonds in the molecule.

A process for the production of paper having high dry strength by separate addition of a water-soluble cationic polymer and of an anionic polymer to a paper stock is disclosed in the prior European application with the application no. EP 09 150 237.7, wherein the anionic polymer is an aqueous dispersion of a water-insoluble polymer having a content of acid groups of not more than 10 mol % or an aqueous dispersion of a nonionic polymer, which dispersion has been made anionic. Draining of the paper stock and drying of the paper products are then effected.

The prior European application with the application number EP 09 152 163.3 discloses a process for the production of paper, board and cardboard having high dry strength, which is likewise characterized by addition of a water-soluble cationic polymer and of an anionic polymer to a paper stock, draining of the paper stock and drying of the paper products. The anionic polymer used there is an aqueous dispersion of at least one anionic latex and at least one degraded starch.

The object of the invention is to provide a further process for the production of paper having a high dry strength and as low wet strength as possible, the dry strength of the paper products being as far as possible further improved compared with the prior art.

The object is achieved, according to the invention, by a process for the production of paper, board and cardboard having high dry strength by addition of an aqueous composition comprising a nanocellulose and at least one polymer, selected from the group consisting of the anionic polymers and water-soluble cationic polymers, draining of the paper stock and drying of the paper products.

In this document, nanocellulose is understood as meaning cellulose forms which are converted by a process step from the state of the natural fiber having the dimensions customary therefore (length about 2000-3000 μm, thickness about 60 μm) into a form in which in particular the thickness dimension is greatly reduced.

The preparation of nanocellulose is disclosed in the literature. For example, WO 2007/091942 A1 discloses a milling process which can be carried out with the use of enzymes. Furthermore, processes are known in which the cellulose is first dissolved in suitable solvents and then precipitated as nanocellulose in the aqueous medium (for example described in WO 2003/029329 A2).

In addition, nanocelluloses are commercially available, for example the products sold by J. Rettenmeier & Söhne GmbH & Co. KG under the trade name commercial product Arbocel®.

The nanocelluloses which are used in the process according to the invention can be dissolved and used in any suitable solvent, for example in water, organic solvents or in any desired mixtures thereof. Such solvents can moreover comprise further constituents, such as, for example, ionic liquids in any desired amounts.

Nanocelluloses which comprise ionic liquids are prepared, for example, by micronizing celluloses present in ionic liquids and in the form of natural fibers in one of the processes described above. Celluloses in the form of the natural fibers which are present in ionic liquids are disclosed, inter alia, in U.S. Pat. No. 6,824,599 B2. The content of this US patent is hereby incorporated by reference.

In particular, in this document, nanocellulose is to be understood as meaning those celluloses whose length dimension is below 1000 μm, preferably below 500 μm, but above 100 nm. Preferably, the length dimension is accordingly from 100 nm to 500 μm, in particular from 100 nm to 100 μm, particularly preferably from 100 nm to 50 μm and especially from 100 nm to 10 μm. The thickness of the cellulose is, for example, in the range from 50 μm to 3 nm. Preferably, the thickness is from 1 μm to 5 nm. The values for thickness and length dimensions stated here are of course average values; for example, at least 50% of the cellulose fibers are in the stated ranges and preferably at least 80% of the cellulose fibers are in the stated ranges.

In another embodiment of the process according to the invention, the preferred nanocellulose is one in which the fiber thickness of at least 80% of the cellulose fibers is from 50 μm to 3 nm, preferably from 1 μm to 5 nm, and which comprises from 5 ppm to 2% by weight, preferably from 10 ppm to 1% by weight, of ionic liquids.

The present invention therefore also relates to such a nanocellulose in which the fiber thickness of at least 80% of the cellulose fibers is from 50 μm to 3 nm, preferably from 1 μm to 5 nm, and which comprises from 5 ppm to 2% by weight, preferably from 10 ppm to 1% by weight, of ionic liquids.

The length dimension and the thickness of the cellulose fibers can be determined, for example, on the basis of cryo-TEM recordings. As described above, the nanocellulose which can be used in the process according to the invention has fiber thicknesses of up to 5 nm and length dimensions of up to 10 mm. These nanocellulose fibers can also be designated as fibrils, the smallest superstructure in cellulose-based substances (5-30 nm wide, depending on the plant variety; degrees of polymerization up to 10 000 anhydroglycose units). They typically have high moduli of elasticity of up to several hundred GPa, and the strengths of such fibrils are in the GPa range. The high stiffness is a result of the crystal structure, in which the long parallel polysaccharide chains are held together by hydrogen bridges. The cryo-TEM method is known to the person skilled in the art. Cryo-TEM in this context means that the aqueous dispersions of the cellulose are frozen and are measured by means of an electron transmission. The nanocellulose fibers are present in the aqueous medium typically in entangled networks comprising a plurality of fibers. This leads at the macroscopic level to a gel. This gel can be measured rheologically, it being found that the storage modulus is greater in absolute terms than the loss modulus. Typically, this gel behavior is present even at concentrations of 0.1 percent by mass of nanocellulose in water.

In the process according to the invention, aqueous slurries of nanocelluloses which comprise from 0.1 to 25% by weight of nanocellulose, based on the total weight of the aqueous slurry, are preferably used. Preferably, the aqueous slurries comprise from 1 to 20% by weight, particularly preferably from 1 to 10% by weight and in particular from 1 to 5% by weight of the nanocellulose.

The aqueous compositions which can be used in the process according to the invention comprise, in addition to the nanocellulose, at least one polymer which is selected from the group consisting of the anionic and water-soluble cationic polymers.

In a preferred embodiment of the process according to the invention, the aqueous composition comprises, in addition to the nanocellulose, at least one anionic polymer. It is also possible for the aqueous composition to comprise at least one water-soluble cationic polymer in addition to the nanocellulose and the anionic polymer.

In another embodiment of the process according to the invention, the aqueous composition comprises, in addition to the nanocellulose, a water-soluble cationic polymer.

In the context of this invention, the anionic polymers are practically insoluble in water. Thus, for example, at a pH of 7.0 under standard conditions (20° C., 1013 mbar), the solubility is not more than 2.5 g of polymer/liter of water, in general not more than 0.5 g/l and preferably not more than 0.1 g/l. Owing to the content of acid groups in the polymer, the dispersions are anionic. The water-insoluble polymer has, for example, a content of acid groups of from 0.1 to 10 mol %, in general from 0.5 to 9 mol % and preferably from 0.5 to 6 mol %, in particular from 2 to 6 mol %. The content of acid groups in the anionic polymer is in general from 2 to 4 mol %.

The acid groups of the anionic polymer are selected, for example, from carboxyl, sulfo and phosphonic acid groups. Carboxyl groups are particularly preferred here.

The anionic polymers comprise, for example, (a) at least one monomer from the group consisting of $C_1$- to $C_{20}$-alkyl acrylates, $C_1$- to $C_{20}$-alkyl methacrylates, vinyl esters of saturated carboxylic acids comprising up to 20 carbon atoms, vinylaromatics having up to 20 carbon atoms, ethylenically unsaturated nitriles, vinyl ethers of saturated, monohydric alcohols comprising 1 to 10 carbon atoms, vinyl halides and aliphatic hydrocarbons having 2 to 8 carbon atoms and one or two double bonds, (b) at least one anionic monomer from the group consisting of the ethylenically unsaturated $C_3$- to $C_8$-carboxylic acids, vinylsulfonic acid, acrylamido-2-methylpropanesulfonic acid, styrenesulfonic acid, vinylphosphonic acid and the salts thereof, (c) optionally at least one monomer from the group consisting of the $C_1$- to $C_{10}$-hydroxyalkyl acrylates, $C_1$- to $C_{10}$-hydroxyalkyl methacrylates, acrylamide, methacrylamide, N—$C_1$- to $C_{20}$-alkylacrylamides and N—$C_1$- to $C_{20}$-alkylmethacrylamides and, (d) optionally at least one monomer having at least two ethylenically unsaturated double bonds in the molecule incorporated in the form of polymerized units.

The anionic polymers comprise, for example, at least 40 mol %, preferably at least 60 mol % and in particular at least 80 mol % of at least one monomer of group (a) incorporated in the form of polymerized units. These monomers are practically water-insoluble or give water-insoluble polymers in a homopolymerization carried out therewith.

The anionic polymers preferably comprise, as a monomer of group (a), mixtures of (i) a $C_1$- to $C_{20}$-alkyl acrylate and/or a $C_1$- to $C_{20}$-alkyl methacrylate and (ii) styrene, α-methylstyrene, p-methylstyrene, α-butylstyrene, 4-n-butylstyrene, butadiene and/or isoprene in the weight ratio of from 10:90 to 90:10 incorporated in the form of polymerized units.

Examples of individual monomers of group (a) of the anionic polymers are acrylates or methacrylates of saturated, monohydric $C_1$- to $C_{20}$-alcohols such as methyl acrylate, methyl methacrylate, ethyl acrylate, ethyl methacrylate, n-propyl acrylate, n-propyl methacrylate, isopropyl acrylate, n-butyl acrylate, sec-butyl acrylate, tert-butyl acrylate, n-butyl methacrylate, sec-butyl methacrylate, tert-butyl methacrylate, n-pentyl acrylate, n-pentyl methacrylate, n-hexyl acrylate, n-hexyl methacrylate, cyclohexyl acrylate, cyclohexyl methacrylate, 2-ethylhexyl acrylate, 2-ethylhexyl methacrylate, n-octyl acrylate, n-octyl methacrylate, n-decyl acrylate, n-decyl methacrylate, 2-propylheptyl acrylate, 2-propylheptyl methacrylate, dodecyl acrylate, dodecyl methacrylate, lauryl acrylate, lauryl methacrylate, palmityl acrylate, palmityl methacrylate, stearyl acrylate and stearyl methacrylate. Among these monomers, the esters of acrylic acid and the methacrylic acid with saturated, monohydric $C_1$- to $C_{10}$-alcohols are preferably used. Mixtures of these monomers are also used in the preparation of the anionic polymers, for example mixtures of n-butyl acrylate and ethyl acrylate or mixtures of n-butyl acrylate and at least one propyl acrylate.

Further monomers of group (a) of the anionic polymers are:

vinyl esters of saturated carboxylic acids having 1 to 20 carbon atoms, e.g. vinyl laurate, vinyl stearate, vinyl propionate, vinyl versatate and vinyl acetate, vinylaromatic compounds, such as styrene, α-methylstyrene, p-methylstyrene, α-butylstyrene, 4-n-butylstyrene and 4-n-decylstyrene, ethylenically unsaturated nitriles, such as acrylonitrile and methacrylonitrile, vinyl ethers of saturated alcohols comprising 1 to 10 carbon atoms, preferably vinyl ethers of saturated alcohols comprising 1 to 4 carbon atoms, such as vinyl methyl ether, vinyl ethyl ether, vinyl-n-propyl ether, vinyl isopropyl ether, vinyl-n-butyl ether or vinyl isobutyl ether, vinyl halides, such as ethylenically unsaturated compounds substituted by chlorine, fluorine or bromine, preferably vinyl chloride and vinylidene chloride, and aliphatic hydrocarbons having one or two olefinic double bonds and 2 to 8 carbon atoms, such as ethylene, propylene, butadiene, isoprene and chloroprene.

Preferred monomers of group (a) are $C_1$-$C_{10}$-alkyl(meth)acrylates and mixtures of the alkyl(meth)acrylates with vinylaromatics, in particular styrene and/or hydrocarbons having two double bonds, in particular butadiene, or mixtures of such hydrocarbons with vinylaromatics, in particular styrene. Particularly preferred monomers of group (a) of the anionic polymers are n-butyl acrylate, styrene and acrylonitrile, which in each case can be used alone or as a mixture. In the case of monomer mixtures, the weight ratio of alkyl acrylates or alkyl methacrylates to vinylaromatics and/or to hydrocarbons having two double bonds, such as butadiene, will be, for example, from 10:90 to 90:10, preferably from 20:80 to 80:20.

Examples of anionic monomers of group (b) of the anionic polymers are ethylenically unsaturated $C_3$- to $C_8$-carboxylic acids, such as, for example, acrylic acid, methacrylic acid, dimethacrylic acid, ethacrylic acid, maleic acid, fumaric acid, itaconic acid, mesaconic acid, citraconic acid, methylene malonic acid, allyl acetic acid, vinyl acetic acid and crotonic acid. Other suitable monomers of group (b) are monomers comprising sulfo groups, such as vinylsulfonic acid, acrylamido-2-methylpropane-sulfonic acid and styrenesulfonic acid, and vinylphosphonic acid. The monomers of this group may be used alone or as a mixture with one another, in partly or in completely neutralized form, in the copolymerization. For example, alkali metal or alkaline earth metal bases, ammonia, amines and/or alkanolamines are used for the neutralization. Examples of these are sodium hydroxide solution, potassium hydroxide solution, sodium carbonate, potassium carbonate, sodium bicarbonate, magnesium oxide, calcium hydroxide, calcium oxide, triethanolamine, ethanolamine, morpholine, diethylenetriamine or tetraethylenepentamine.

The water-insoluble anionic polymers may optionally comprise at least one monomer from group consisting of $C_1$- to $C_{10}$-hydroxyalkyl acrylates, $C_1$- to $C_{10}$-hydroxyalkyl methacrylates, acrylamide, methacrylamide, N—$C_1$- to $C_{20}$-alkylacrylamides and N—$C_1$- to $C_{20}$-alkylmethacrylamides as further monomers (c). If these monomers are used for modifying the anionic polymers, acrylamide or methacrylamide is preferably used. The amounts of monomers (c) incorporated in the form of polymerized units in the anionic polymer are up to, for example, 20 mol %, preferably up to 10 mol %, and, if these monomers are used in the polymerization, are in the range of from 1 to 5 mol %.

Furthermore the anionic polymers may optionally comprise monomers of group (d).

Suitable monomers of group (d) are compounds having at least two ethylenically unsaturated double bonds in the molecule. Such compounds are also referred to as crosslinking agents. They comprise, for example, from 2 to 6, preferably from 2 to 4 and generally 2 or 3 double bonds capable of free radical polymerization in the molecule. The double bonds may be, for example, the following groups: acrylate, methacrylate, vinyl ether, vinyl ester, allyl ether and allyl ester groups. Examples of crosslinking agents are 1,2-ethanediol di(meth)acrylate (here and in the following text, the notation " . . . (meth)acrylate" or "(meth)acrylic acid" means both " . . . acrylate" and " . . . methacrylate" or acrylic acid as well as methacrylic acid), 1,3-propanediol di(meth)acrylate, 1,2-propanediol di(meth)acrylate, 1,4-butanediol di(meth)acrylate, 1,6-hexanediol di(meth)acrylate, neopentylglycol di(meth)acrylate, trimethylolpropanetriol di(meth)acrylate, pentaerythritol tetra(meth)acrylate, 1,4-butane-diol divinyl ether, 1,6-hexanediol divinyl ether, 1,4-cyclohexanediol divinyl ether, divinylbenzene, allyl acrylate, allyl methacrylate, methallyl acrylate, methallyl methacrylate, but-3-en-2-yl (meth)acrylate, but-2-en-1-yl(meth)acrylate, 3-methylbut-2-en-1-yl(meth)acrylate, esters of (meth)acrylic acid with geraniol, citronellal, cinnamic alcohol, glyceryl mono- or diallyl ether, trimethylolpropane mono- or -diallyl ether, ethylene glycol monoallyl ether, diethylene glycol monoallyl ether, propylene glycol monoallyl ether, dipropylene glycol monoallyl ether, 1,3-propanediol monoallyl ether, 1,4-butanediol monoallyl ether and furthermore diallyl itaconate. Allyl acrylate, divinylbenzene, 1,4-butanediol diacrylate and 1,6-hexanediol diacrylate are preferred. If a crosslinking agent is used for modifying the anionic polymers, the amounts incorporated in the form polymerized units are up to 2 mol %. They are, for example, in the range from 0.001 to 2, preferably from 0.01 to 1, mol %.

The water-insoluble anionic polymers preferably comprise, as monomers (a), mixtures of 20-50 mol % of styrene and 30-80 mol % of at least one alkyl methacrylate and/or at least one alkyl acrylate incorporated in the form of polymerized units. They may optionally also comprise up to 30 mol % of methacrylonitrile or acrylonitrile incorporated in the form of polymerized units. Such polymers may optionally also be modified by the amounts of methacrylamide and/or acrylamide which are stated above under monomers from group (c).

Preferred anionic polymers comprise (a) at least 60 mol % of at least one monomer from the group consisting of a $C_1$- to $C_{20}$-alkyl acrylate, a $C_1$- to $C_{20}$-alkyl methacrylate, vinyl acetate, vinyl propionate, styrene, α-methylstyrene, p-methylstyrene, α-butylstyrene, 4-n-butylstyrene, 4-n-decylstyrene, acrylonitrile, methacrylonitrile, butadiene and isoprene and (b) from 0.5 to 9 mol % of at least one anionic monomer from the group consisting of the ethylenically unsaturated $C_3$- to $C_5$-carboxylic acids incorporated in the form of polymerized units.

Anionic polymers which comprise at least 80 mol % of at least one monomer of group (a) incorporated in the form of polymerized units are particularly preferred. They generally comprise, as a monomer of group (a), mixtures of (i) a $C_1$- to $C_{20}$-alkyl acrylate and/or a $C_1$- to $C_{20}$-alkyl methacrylate and (ii) styrene, α-methylstyrene, p-methylstyrene, α-butylstyrene, 4-n-butylstyrene, butadiene and/or isoprene in the weight ratio of from 10:90 to 90:10 incorporated in the form of polymerized units.

The preparation of the anionic polymers is effected as a rule by emulsion polymerization. The anionic polymers are therefore emulsion polymers. The preparation of aqueous polymer dispersions by the free radical emulsion polymerization process is known per se (cf. Houben-Weyl, Methoden der organischen Chemie, volume XIV, Makromolekulare Stoffe, Georg Thieme Verlag, Stuttgart 1961, page 133 et seq.).

In the emulsion polymerization for the preparation of the anionic polymers, ionic and/or nonionic emulsifiers and/or protective colloids or stabilizers are used as surface-active compounds. The surface-active substance is usually used in amounts of from 0.1 to 10% by weight, in particular from 0.2 to 3% by weight, based on the monomers to be polymerized.

Customary emulsifiers are, for example, ammonium or alkali metal salts of higher fatty alcohol sulfates, such as sodium n-laurylsulfate, fatty alcohol phosphates, ethoxylated $C_8$- to $C_{10}$-alkylphenols having a degree of ethoxylation of from 3 to 30 and ethoxylated $C_8$- to $C_{25}$-fatty alcohols having a degree of ethoxylation of from 5 to 50. Mixtures of nonionic and ionic emulsifiers are also conceivable. Ethoxylated and/or propoxylated alkylphenols and/or fatty alcohols containing phosphate or sulfate groups are furthermore suitable. Further suitable emulsifiers are mentioned in Houben-Weyl, Methoden der organischen Chemie, volume XIV, Makromolekulare Stoffe, Georg Thieme Verlag, Stuttgart, 1961, pages 192 to 209.

Water-soluble initiators for the emulsion polymerization for the preparation of the anionic polymers are, for example, ammonium and alkali metal salts of peroxodisulfuric acid, e.g. sodium peroxodisulfate, hydrogen peroxide or organic peroxides, e.g. tert-butyl hydroperoxide.

So-called reduction-oxidation (redox) initiator systems are also suitable, for example combinations of peroxides, hydroperoxides or hydrogen peroxide with reducing agents, such as ascorbic acid or sodium bisulfite. These initiator systems may additionally comprise metal ions, such as iron(II) ions.

The amount of initiators is in general from 0.1 to 10% by weight, preferably from 0.5 to 5% by weight, based on the monomers to be polymerized. It is also possible to use a plurality of different initiators in the emulsion polymerization.

In the emulsion polymerization, it is optionally possible to use regulators, for example in amounts of from 0 to 3 parts by weight, based on 100 parts by weight of the monomers to be polymerized. As a result, the molar mass of the resulting polymers is reduced. Suitable regulators are, for example, compounds having a thiol group, such as tert-butyl mercaptan, thioglycolic acid ethyl acrylate, mercaptoethanol, mercaptopropyltrimethoxysilane or tert-dodecyl mercaptan, or regulators without a thiol group, in particular, for example, terpinolene.

The emulsion polymerization for the preparation of the anionic polymers is effected as a rule at from 30 to 130° C., preferably of from 50 to 100° C. The polymerization medium may consist both only of water and of mixtures of water and liquids miscible therewith, such as methanol. Preferably, only water is used. The emulsion polymerization can be carried out both as a batch process and in the form of a feed process, including step or gradient procedure. Preferred is the feed process in which a part of the polymerization batch is initially taken, heated to the polymerization temperature and partly polymerized and then the remainder of the polymerization batch is fed to the polymerization zone continuously, stepwise or with superposition of a concentration gradient while maintaining the polymerization, usually via a plurality of spatially separate feeds, one or more of which comprise the monomers in pure or emulsified form. In the polymerization, a polymer seed may also be initially taken, for example for better adjustment of the particle size.

The manner in which the initiator is added to the polymerization vessel in the course of the free radical aqueous emulsion polymerization is known to the average person skilled in the art. It may be either completely initially taken in the polymerization vessel or used continuously or stepwise at the rate of its consumption in the course of a free radical emulsion polymerization. Specifically, this depends on the chemical nature of the initiator system as well as on the polymerization temperature. Preferably, a part is initially taken and the remainder is fed to the polymerization zone at the rate of consumption.

For removing the residual monomers, at least one initiator is again added, usually also after the end of the actual emulsion polymerization, i.e. after a conversion of the monomers of at least 95%, and the reaction mixture is heated for a certain time to a polymerization temperature or a temperature above this.

The individual components can be added to the reactor in the feed process from above, at the side or from below through the reactor bottom.

After the (co)polymerization, the acid groups present in the anionic polymer may also be at least partly or completely neutralized. This can be effected, for example, with oxides, hydroxides, carbonates or bicarbonates of alkali metals or alkaline earth metals, preferably with hydroxides, with which any desired counter-ion or a plurality thereof may be associated, e.g. $Li^+$, $Na^+$, $K^+$, $Cs^+$, $Mg^{2+}$, $Ca^{2+}$ or $Ba^{2+}$. Furthermore, ammonia or amines are suitable for the neutralization. Aqueous ammonium hydroxide, sodium hydroxide or potassium hydroxide solutions are preferred.

In the emulsion polymerization, aqueous dispersions of the anionic polymer as a rule with solids contents of from 15 to 75% by weight, preferably from 40 to 75% by weight, are obtained. The molar mass $M_w$ of the anionic polymers is, for example, in the range from 100 000 to 1 million dalton. If the polymers have a gel phase, a molar mass determination is not directly possible. The molar masses are then above the above mentioned range.

The glass transition temperature Tg of the anionic polymers is, for example in the range from −30 to 100° C., preferably in the range from −5 to 70° C. and particularly preferably in the range from 0 to 40° C. (measured by the DSC method according to DIN EN ISO 11357).

The particle size of the dispersed anionic polymers is preferably in the range from 10 to 1000 nm, particularly preferably in the range from 50 to 300 nm (measured using a Malvern® Autosizer 2 C).

The anionic polymer may optionally comprise small amounts of cationic monomer units incorporated in the form of polymerized units, so that amphoteric polymers are present, but the total charge of the polymers must be anionic. Other suitable anionic polymers are polymer dispersions of nonionic monomers which are emulsified with the aid of anionic surfactants or emulsifiers (such compounds were described above in the case of the emulsion polymerization for the preparation of anionic polymers). For this application, the surfactants or emulsifiers are used, for example, in amounts of from 1 to 15% by weight, based on the total dispersion.

As described above, in addition to the nanocellulose, the aqueous composition may also comprise a water-soluble cationic polymer in addition or alternatively to the anionic polymer.

Suitable cationic polymers are all water-soluble cationic polymers mentioned in the prior art cited at the outset. These are, for example, compounds carrying amino or ammonium groups. The amino groups may be primary, secondary, tertiary or quaternary groups. For the polymers, in essence addition polymers, polyaddition compounds or polycondensates are suitable, it being possible for the polymers to have a linear or branched structure, including hyperbranched or dendritic structures. Graft polymers may also be used. In the present context, the cationic polymers are referred to as being water-soluble if their solubility in water under standard conditions (20° C., 1013 mbar) and pH 7.0 is, for example, at least 10% by weight.

The molar masses of $M_w$ of the cationic polymers are, for example, at least 1000 g/mol. They are, for example, generally in the range from 5000 to 5 million g/mol. The charge densities of the cationic polymers are, for example, from 0.5 to 23 meq/g of polymer, preferably from 3 to 22 meq/g of polymer and in general from 6 to 20 meq/g of polymer.

Example of suitable monomers for the preparation of cationic polymers are:

Esters of α,β-ethylenically unsaturated mono- and dicarboxylic acids with amino alcohols, preferably $C_2$-$C_{12}$-amino alcohols. These will be $C_1$-$C_8$-monoalkylated or dialkylated at the amine nitrogen. Suitable acid components of these esters are, for example, acrylic acid, methacrylic acid, fumaric acid, maleic acid, itaconic acid, crotonic acid, maleic anhydride, monobutyl maleate and mixtures thereof. Acrylic acid, methacrylic acid and mixtures thereof are preferably used. These include, for example, N-methylaminomethyl (meth)acrylate, N-methylaminoethyl(meth)acrylate, N,N-dimethylaminomethyl(meth)acrylate, N,N-dimethylaminoethyl(meth)acrylate, N,N-diethylaminoethyl(meth)acrylate, N,N-dimethylaminopropyl(meth)acrylate, N,N-diethylaminopropyl(meth)acrylate and N,N-dimethylaminocyclohexyl (meth)acrylate.

Also suitable are the quaternization products of the above compounds with $C_1$-$C_8$-alkyl chlorides, $C_1$-$C_8$-dialkyl sulfates, $C_1$-$C_{16}$-epoxides or benzyl chloride.

In addition, N-[2-(dimethylamino)ethyl]acrylamide, N-[2-dimethylamino)ethyl]methacrylamide, N-[3-(dimethylamino)propyl]acrylamide, N-[3-(dimethylamino)propyl] methacrylamide, N-[4-(dimethylamino)butyl]acrylamide, N-[4-(dimethylamino)butyl]methacrylamide, N-[2-(diethylamino)ethyl]acrylamide, N-[2-(diethylamino)ethyl]methacrylamide and mixtures thereof are suitable as further monomers.

Also suitable are the quaternization products of the above compounds with $C_1$-$C_8$-alkyl chloride, $C_1$-$C_8$-dialkyl sulfate, $C_1$-$C_{16}$-epoxides or benzyl chloride.

Suitable monomers are furthermore N-vinylimidazoles, alkylvinylimidazoles, in particular methylvinylimidazoles, such as 1-vinyl-2-methylimidazole, 3-vinylimidazole N-oxide, 2- and 4-vinylpyridines, 2- and 4-vinylpyridine N-oxides and betaine derivatives and quaternization products of these monomers.

Further suitable monomers are allylamine, dialkyldiallylammonium chlorides, in particular dimethyldiallylammonium chloride and diethyldiallylammonium chloride, and the monomers disclosed in WO 01/36500 A1, comprising alkyleneimine units and of the formula (II)

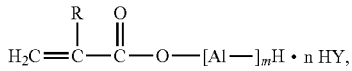

(II)

where

R is hydrogen or $C_1$- to $C_4$-alkyl,

—[Al—]$_m$ is a linear or branched oligoalkyleneimine chain having m alkyleneimine units, m is an integer in the range from 1 to 20, and the number average m in the oligoalkyleneimine chains is at least 1.5, Y is the anion equivalent of a mineral acid and n is a number such that $1 \leq n \leq m$.

Monomers or monomer mixtures in which the number average of m is at least 2.1, in general from 2.1 to 8, in the above mentioned formula (II) are preferred. They are obtainable by reacting an ethylenically unsaturated carboxylic acid with an oligoalkyleneimine, preferably in the form of an oligomer mixture. The resulting product may optionally be converted with a mineral acid HY into the acid addition salt. Such monomers can be polymerized to give cationic homo- and copolymers in an aqueous medium in the presence of an initiator which initiates a free radical polymerization.

Further suitable cationic monomers are disclosed in WO 2009/043860 A1. These are aminoalkyl vinyl ethers comprising alkyleneimine units and of the formula (III)

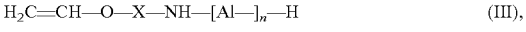

(III), where

[Al—]$_n$ is a linear or branched oligoalkyleneimine chain having n alkyleneimine units, n is a number of at least 1 and X is a straight-chain or branched $C_2$- to $C_6$-alkylene group, and salts of the monomers (III) with mineral acids or organic acids and quaternization products of the monomers (III) with alkyl halides or dialkyl sulfates. These compounds are obtainable by an addition reaction of alkyleneimines with amino-$C_2$- to $C_6$-alkyl vinyl ethers.

The above mentioned monomers can be polymerized alone to give water-soluble cationic homopolymers or together with at least one other neutral monomer to give water-soluble cationic copolymers or with at least one monomer having acid groups to give amphoteric copolymers which, in the case of a molar excess of cationic monomers incorporated in the form of polymerized units, carry an overall cationic charge.

Suitable neutral monomers which are copolymerized with the above mentioned cationic monomers for the preparation of cationic polymers are, for example, esters of α,β-ethylenically unsaturated mono- and dicarboxylic acids with $C_1$-$C_{30}$-alkanols, $C_2$-$C_{30}$-alkanediols, amides of α,β-ethylenically unsaturated monocarboxylic acids and the N-alkyl and N,N-dialkyl derivatives thereof, esters of vinyl alcohol and allyl alcohol with saturated $C_1$-$C_{30}$-monocarboxylic acids, vinylaromatics, vinyl halides, vinylidene halides, $C_2$-$C_8$-monoolefins and mixtures thereof.

Further suitable comonomers are, for example, methyl (meth)acrylate, methyl ethacrylate, ethyl(meth)acrylate, ethyl ethacrylate, n-butyl(meth)acrylate, isobutyl(meth)acrylate, tert-butyl(meth)acrylate, tert-butyl ethacrylate, n-octyl (meth)acrylate, 1,1,3,3-tetramethylbutyl(meth)acrylate, ethylhexyl(meth)acrylate and mixtures thereof.

Also suitable are acrylamide, substituted acrylamides, methacrylamide, substituted methacrylamides, such as, for example, acrylamide, methacrylamide, N-methyl(meth)acrylamide, N-ethyl(meth)acrylamide, N-propyl(meth)acrylamide, N-(n-butyl)(meth)acrylamide, tert-butyl(meth)acrylamide, n-octyl(meth)acrylamide, 1,1,3,3-tetramethylbutyl (meth)acrylamide and ethylhexyl(meth)acrylamide, and acrylonitrile and methacrylonitrile and mixtures of said monomers.

Further monomers for modifying the cationic polymers are 2-hydroxyethyl(meth)acrylate, 2-hydroxyethyl ethacrylate, 2-hydroxypropyl(meth)acrylate, 3-hydroxypropyl(meth) acrylate, 3-hydroxybutyl(meth)acrylate, 4-hydroxybutyl (meth)acrylate, 6-hydroxyhexyl(meth)acrylate, etc. and mixtures thereof.

Further suitable monomers for the copolymerization with the above mentioned cationic monomers are N-vinyllactams and derivatives thereof which may have, for example, one or more $C_1$-$C_6$-alkyl substituents, such as methyl, ethyl, n-propyl, isopropyl, n-butyl, sec-butyl, tert-butyl, etc. These include, for example, N-vinylpyrrolidone, N-vinylpiperidone, N-vinylcaprolactam, N-vinyl-5-methyl-2-pyrrolidone, N-vinyl-5-ethyl-2-pyrrolidone, N-vinyl-6-methyl-2-piperidone, N-vinyl-6-ethyl-2-piperidone, N-vinyl-7-methyl-2-caprolactam, N-vinyl-7-ethyl-2-caprolactam, etc.

Suitable comonomers for the copolymerization with the above mentioned cationic monomers are furthermore ethylene, propylene, isobutylene, butadiene, styrene, α-methylstyrene, vinyl chloride, vinylidene chloride, vinyl fluoride, vinylidene fluoride and mixtures thereof.

A further group of comonomers comprises ethylenically unsaturated compounds which carry a group from which an amino group can be formed in a polymer-analogous reaction. These include, for example, N-vinylformamide, N-vinyl-N-methylformamide, N-vinylacetamide, N-vinyl-N-methylacetamide, N-vinyl-N-ethylacetamide, N-vinylpropionamide, N-vinyl-N-methylpropionamide and N-vinylbutyramide and mixtures thereof. The polymers formed therefrom can, as described in EP 0 438 744 A1, be converted by acidic or basic hydrolysis into polymers comprising vinylamine and amidine units (formulae IV-VII)

(IV)

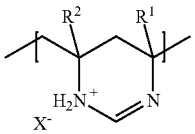

(V)

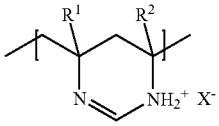

(VI)

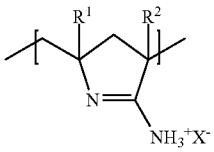

-continued (VII)

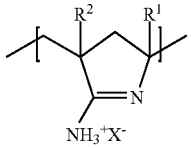

In the formulae IV-VII, the substituents $R^1$, $R^2$ are H, $C_1$- to $C_6$-alkyl and $X^-$ is an anion equivalent of an acid, preferably of a mineral acid.

For example, polyvinylamines, polyvinylmethylamines or polyvinylethylamines form in the hydrolysis. The monomers of this group can be polymerized in any desired manner with the cationic monomers and/or the above mentioned comonomers.

Cationic polymers are also to be understood in the context of the present invention as meaning amphoteric polymers which carry an overall cationic charge. In the amphoteric polymers, the content of cationic groups is, for example, at least 5 mol % above the content of anionic groups in the polymer. Such polymers are obtainable, for example, by copolymerizing a cationic monomer, such as N,N-dimethylaminoethylacrylamide, in the form of the free base, in the form partly neutralized with an acid or in quaternized form, with at least one monomer comprising acids groups, the cationic monomer being used in a molar excess so that the resulting polymers carry an overall cationic charge.

Amphoteric polymers are also obtainable by copolymerization of (i) at least one N-vinylcarboxamide of the formula (I)

(I)

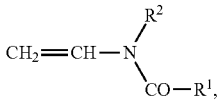

where $R^1$, $R^2$ are H or $C_1$- to $C_6$-alkyl, (ii) at least one monoethylenically unsaturated carboxylic acid having 3 to 8 carbon atoms in the molecule and/or the alkali metal, alkaline earth metal or ammonium salts thereof and optionally (iii) other monoethylenically unsaturated monomers and optionally (iv) compounds which have at least two ethylenically unsaturated double bonds in the molecule, and subsequent partial or complete elimination of groups —CO—$R^1$ from the monomers of the formula (I) which are incorporated in the form of polymerized units in the copolymer, with formation of amino groups, the content of cationic groups, such as amino groups, in the copolymer being at least 5 mol % above the content of acid groups of the monomers (ii) incorporated in the form of polymerized units. In the hydrolysis of N-vinylcarboxamide polymers, amidine units form in a secondary reaction by reaction of vinylamine units with a neighboring vinyl formamide unit. Below, the mention of vinylamine units in the amphoteric copolymers always means the sum of vinylamine and amidine units.

The amphoteric compounds thus obtainable comprise, for example, ($i_1$) optionally, unhydrolyzed units of the formula (I), ($i_2$) vinylamine units and amidine units, the content of amino plus amidine groups in the copolymer being at least 5 mol % above the content of monomers comprising acid groups and incorporated in the form of polymerized units, (ii) units of a monoethylenically unsaturated monomer comprising acid groups and/or the alkali metal, alkaline earth metal or ammonium salts thereof, (iii) from 0 to 30 mol % of units of at least one other monoethylenically unsaturated monomer and (iv) from 0 to 2 mol % of at least one compound which has at least two ethylenically unsaturated double bonds in the molecule.

The hydrolysis of the copolymers can be carried out in the presence of acids or bases or enzymatically. In the hydrolysis with acids, the vinylamine groups forming from the vinylcarboxamide units are present in salt form. The hydrolysis of vinylcarboxamide copolymers is described in detail in EP 0 438 744 A1, page 8, line 20 to page 10, line 3. The statements made there apply accordingly for the preparation of the amphoteric polymers to be used according to the invention and having an overall cationic charge.

These polymers have, for example, K values (determined after H. Fikentscher in 5% strength aqueous sodium chloride solution at pH 7, a polymer concentration of 0.5% by weight and a temperature of 25° C.) in the range from 20 to 250, preferably from 50 to 150.

The preparation of the cationic homo- and copolymers can be effected by solution, precipitation, suspension or emulsion polymerization. Solution polymerization in the aqueous media is preferred. Suitable aqueous media are water and mixtures of water and at least one water-miscible solvent, for example an alcohol, such as methanol, ethanol, n-propanol, etc.

The polymerization temperatures are preferably in a range from about 30 to 200° C., particularly preferably from 40 to 110° C. The polymerization is usually effected under atmospheric pressure but can also take place under reduced or superatmospheric pressure. A suitable pressure range is from 0.1 to 5 bar.

For the preparation of the cationic polymers, the monomers can be polymerized with the aid of free radical initiators.

Free radical polymerization initiators which may be used are the peroxo and/or azo compounds customary for this purpose, for example alkali metal or ammonium peroxodisulfate, diacetyl peroxide, dibenzoyl peroxide, succinyl peroxide, di-tert-butyl peroxide, tert-butyl perbenzoate, tert-butyl perpivalate, tert-butyl peroxy-2-ethylhexanoate, tert-butyl permaleate, cumyl hydroperoxide, diisopropyl peroxydicarbamate, bis(o-toluyl)peroxide, didecanoyl peroxide, dioctanoyl peroxide, dilauroyl peroxide, tert-butyl perisobutyrate, tert-butyl peracetate, di-tert-amyl peroxide, tert-butyl hydroperoxide, azobisisobutyronitrile, azobis(2-amidinopropane)dihydrochloride or 2-2'-azobis(2-methylbutyronitrile). Also suitable are initiator mixtures or redox initiator systems, such as, for example, ascorbic acid/iron(II) sulfate/sodium peroxodisulfate, tert-butyl hydroperoxide/sodium disulfite, tert-butyl hydroperoxide/sodium hydroxymethanesulfinate, $H_2O_2$/Cu(I) or iron(II) compounds.

For adjusting the molecular weight, the polymerization can be effected in the presence of at least one regulator. Regulators which may be used are the customary compounds known to the person skilled in the art, such as for example sulfur compounds, e.g. mercaptoethanol, 2-ethylhexyl thioglycolate, or thioglycolic acid, sodium hypophosphite, formic acid or dodecyl mercaptan and tribromochloromethane or other compounds which regulate the molecular weight of the polymers obtained.

Cationic polymers, such as polyvinylamines and copolymers thereof, can also be prepared by Hofmann degradation of polyacrylamide or polymethacrylamide and copolymers thereof, cf. H. Tanaka, Journal of Polymer Science: Polymer Chemistry edition 17,1239-1245 (1979) and El Achari, X. Coqueret, A. Lablache-Combier, C. Loucheux, Makromol. Chem., Vol. 194, 1879-1891 (1993).

All the above mentioned cationic polymers can be modified by carrying out the polymerization of the cationic monomers and optionally of the mixtures of cationic monomers and the comonomers in the presence of at least one crosslinking agent. A crosslinking agent is understood as meaning those monomers which comprise at least two double bonds in the molecule, e.g. methylenebisacrylamide, glycol diacrylate, glycol dimethacrylate, glyceryl triacrylate, pentaerythritol triallyl ether, polyalkylene glycols which are at least diesterified with acrylic acid and/or methacrylic acid or polyols such as pentaerythritol, sorbitol or glucose. If at least one crosslinking agent is used in the copolymerization, the amounts used are, for example, up to 2 mol %, e.g. from 0.001 to 1 mol %.

Furthermore, the cationic polymer can be modified by the subsequent addition of crosslinking agents, i.e. by the addition of compounds which have at least two groups reactive to amino groups, such as, for example,

- di- and polyglycidyl compounds,
- di- and polyhalogen compounds,
- compounds having two or more isocyanate groups, possibly blocked carbonic acid derivatives,
- compounds which have two or more double bonds which are suitable for a Michael addition,
- di- and polyaldehydes,
- monoethylenically unsaturated carboxylic acids and the esters and anhydrides thereof.

Suitable cationic compounds are moreover polymers which can be produced by polyaddition reactions, such as, in particular, polymers based on aziridines. It is possible both for homopolymers to form but also graft polymers, which are produced by grafting of aziridines on other polymers. It may also be advantageous here to add, during or after the polyaddition, which have at least two groups which can react with the aziridines or the amino groups formed, such as, for example, epichlorohydrin or dihaloalkanes. Crosslinking agent (cf. Ullmann's Encyclopedia of Industrial Chemistry, VCH, Weinheim, 1992, chapter on aziridines).

Preferred polymers of this type are based on ethyleneimine, for example homopolymers of ethyleneimine which are prepared by polymerization of ethyleneimine or polymers grafted with ethyleneimine, such as polyamidoamines.

Further suitable cationic polymers are reaction products of dialkylamines with epichlorohydrin or with di- or polyfunctional epoxides, such as, for example, reaction products of dimethylamine with epichlorohydrin.

Other suitable cationic polymers are polycondensates, e.g. homo- or copolymers of lysine, arginine and histidine. They can be used as homopolymers or as copolymers with other natural or synthetic amino acids or lactams. For example, glycine, alanine, valine, leucine, phenylalanine, tryptophan, proline, asparagine, glutamine, serine, threonine or caprolactam are suitable for the copolymerization.

Furthermore, condensates of difunctional carboxylic acids with polyfunctional amines may be used as cationic polymers, the polyfunctional amines carrying at least two primary amino groups and at least one further less reactive, i.e. secondary, tertiary or quaternary, amino group. Examples are the polycondensation products of diethylenetriamine or triethylenetetramine with adipic, malonic, glutaric, oxalic or succinic acid.

Polysaccharides carrying amino groups, such as, for example, chitosan, are also suitable as cationic polymers.

Furthermore, all the polymers which are described above and carry primary or secondary amino groups can be modified by means of reactive oligoethyleneimines, as described in WO 2009/080613 A1. This application describes graft polymers whose grafting base is selected from the group consisting of polymers having vinylamine units, polyamines, polyamidoamines and polymers of ethylenically unsaturated acids and which comprise, as side chains, exclusively oligoalkyleneimine side chains. The preparation of graft polymers having oligoalkyleneimine side chains is effected by grafting at least one oligoalkyleneimine which comprises a terminal aziridine group onto one of said grafting bases.

In a preferred embodiment of the process according to the invention, a polymers having vinylamine units is used as the water-soluble cationic polymer.

The present invention also relates to an aqueous composition comprising a nanocellulose and at least one polymer selected from the group consisting of the anionic polymers and water-soluble cationic polymers, as can be used in the process according to the invention which is described above.

Suitable fibers for the production of pulps are all qualities customary for this purpose, e.g. mechanical pulp, bleached and unbleached chemical pulp and paper stocks from all annual plants. Mechanical pulp includes, for example, groundwood, thermomechanical pulp (TMP), chemothermomechanical pulp (CTMP), pressure groundwood, semichemical pulp, high-yield chemical pulp and refiner mechanical pulp (RMP). For example, sulfate, sulfite and soda pulps are suitable as chemical pulp. Preferably unbleached chemical pulp, which is also referred to as unbleached kraft pulp, is used. Suitable annual plants for the production of paper stocks are, for example, rice, wheat, sugarcane, and kenaf. Pulps are generally produced using wastepaper, which is used either alone or as a mixture with other fibers, or fiber mixtures comprising a primary pulp and recycled coated waste, e.g. bleached pine sulfate mixed with recycled coated waste, are used as starting materials.

The process according to the invention is of particular industrial interest for the production of paper and board from waste paper because it substantially increases the strength properties of the recycled fibers and is particularly important for improving strength properties of graphic arts papers and of packaging papers. The papers obtainable by the process according to the invention surprisingly have a higher dry strength than the papers which can be produced by the process of WO 2006/056381 A1.

The pH of the stock suspension is, for example, in the range from 4.5 to 8, in general from 6 to 7.5. For example, an acid, such as sulfuric acid, or aluminum sulfate can be used for adjusting the pH.

In the process according to the invention, the aqueous composition comprising a nanocellulose and at least one polymer is first prepared. It is unimportant whether the nanocellulose is initially taken first and the at least one polymer is added to the nanocellulose, or vice versa. If both an anionic polymer and a water-soluble cationic polymer are added, the sequence is likewise unimportant.

In a preferred embodiment of the process according to the invention, the aqueous slurry of the nanocellulose is first heated, for example to 60° C., preferably to 50° C. and particularly preferably to a range from 30 to 50° C. Thereafter, an aqueous dispersion of at least one anionic polymer is metered in. It is also possible, if required, also to add at least one cationic polymer to this aqueous composition.

In another preferred embodiment of the process according to the invention, at least one cationic polymer is added to the aqueous composition, this at least one cationic polymer preferably being added to an aqueous slurry of a nanocellulose, which slurry has been heated as described above. The anionic polymer is then optionally added.

Independently of the above-mentioned embodiments, the aqueous composition in the process according to the invention can be added to the high-consistency stock (fiber concentration >15 g/l, e.g. in the range from 25 to 40 g/l to 60 g/l) or preferably to a low-consistency stock (fiber concentration <15 g/l, e.g. in the range from 5 to 12 g/l). The point of addition is preferably before the wires but may also be between a shear stage and a screen or thereafter.

The water-insoluble anionic polymer is used, for example, in an amount of from 0.1 to 10% by weight, preferably from 0.3 to 6% by weight, in particular from 0.5 to 5.5% by weight, based on dry paper stock. The optionally used cationic polymer is used, for example, in an amount of from 0.03 to 2.0% by weight, preferably from 0.1 to 0.5% by weight, based on dry paper stock.

The weight ratio of optionally used water-soluble cationic polymer to water-insoluble anionic polymer is, based on the solids content, for example from 1:5 to 1:20 and is preferably in the range from 1:10 to 1:15 and particularly preferably in the range from 1:10 to 1:12.

In the process according to the invention, the process chemicals usually used in papermaking can be used in the customary amounts, e.g. retention aid, draining agent, other dry strength agents, such as, for example, starch, pigments, fillers, optical brighteners, antifoams, biocides and paper dyes.

The invention is explained in more detail by means of the following non-limiting examples.

EXAMPLES

Unless stated otherwise, the reported percentages in the examples are percent by weight.

The K value of the polymers was determined according to Fikentscher, Cellulose-Chemie, volume 13, 58-64 and 71-74 (1932) at a temperature of 20° C. in 5% strength by weight aqueous sodium chloride solutions at a pH of 7 and a polymer concentration of 0.5%. In this context, K=k·1000.

The stated mean particle sizes were determined according to ISO 13321 by quasi-elastic light scattering using a Malvern® Autosizer 2 C on 0.01% strength by weight samples.

The following polymers were tested in the examples and comparative examples:

Cationic Polymer A

This polymer was prepared by hydrolysis of a poly-N-vinylformamide with hydrochloric acid. The degree of hydrolysis of the polymer was 50 mol %, i.e. the polymer comprised 50 mol % of N-vinylformamide units and 50 mol % of vinylamine units in salt form. The K value of the water-soluble cationic polymer was 90.

Anionic Polymer B

The anionic polymer B was present as anionic acrylate resin having a solids content of 50% and was obtained by suspension polymerization of 68 mol % of n-butyl acrylate, 14 mol % of styrene, 14 mol % of acrylonitrile and 4 mol % of acrylic acid. The mean particle size of the dispersed polymer particles was 192 nm.

Anionic Polymer C

The anionic polymer C was present as anionic acrylate resin having a solids content of 50% and was obtained by suspension polymerization of 87 mol % of n-butyl acrylate, 5 mol % of styrene, 5 mol % of acrylonitrile and 3 mol % of acrylic acid. The mean particle size of the dispersed polymer particles was 184 nm.

Nanocellulose

A spinning disk reactor which was equipped with a feed for cellulose solution and four feeds for water was used for the preparation of the nanocellulose. The feed for the cellulose solution was positioned centrally above the axis of the disk, 1 mm away from the disk surface. The water feeds were positioned at equal distances from one another, in each case 5 cm away from the axis and 1 mm away from the disk surface. The disk surface and the jacket of the spinning disk reactor were heated to 95° C. The reactor was filled with nitrogen. At a disk rotation speed of 2500 revolutions per min, solutions of cellulose in an ionic liquid (cellulose from Weyerhauser, 1% by weight in 1-ethyl-3-methylimidazolium acetate, dose 50 g/min at 2 bar nitrogen pressure) which were at 80° C. were metered onto the disk in the course of 5 minutes. At the same time, water at 80° C. was added in a dose of 1000 ml/min via the four water feeds. The product suspension obtained was filtered over a fluted filter after cooling, and washed in portions with 1000 ml of water altogether. Thereafter, the cellulose fibers were washed with about 200 ml of isopropanol and filled in the isopropanol-moist state. The nanocellulose still comprised 0.4% by weight of 1-Ethyl-3-methylimidizaolium acetate and about 95% of the cellulose fibers had a fiber thickness of from 5 to 200 nm.

Example 1

200 ml of a 10% strength nanocellulose suspension were heated to 50° C. 0.25% by weight of the cationic polymer A (solid polymer, based on dry nanocellulose) was added thereto. In another container, the anionic polymer B was diluted with water by the factor 10. The dilute dispersion of the anionic polymer B was then metered with gentle stirring into the heated nanocellulose suspension. The amount of acrylate resin used was 25% by weight (solid polymer, based on dry nanocellulose).

A 0.5% strength by weight aqueous stock suspension was prepared from 100% mixed wastepaper. The pH of the suspension was 7.1 and the freeness of the stock was 50° Schopper-Riegler (° SR).

The treated nanocellulose suspension was added to the wastepaper stock with stirring. The metered amount of treated nanocellulose (solid), based on wastepaper stock (solid), was 5%. Sheets having a basis weight of 120 g/m$^2$ were then produced from the treated wastepaper stock on a Rapid-Köthen sheet former according to ISO 5269/2. The sheets were dried by means of contact on one side with a stream-heated metal cylinder for 7 minutes at 90° C.

Example 2

200 ml of a 10% strength nanocellulose suspension were heated to 30° C. In another container, the anionic polymer C was diluted with water by the factor 10. The dilute dispersion was then metered with gentle stirring into the heated nanocellulose suspension. The amount of acrylate resin used was 25% by weight (solid polymer, based on dry nanocellulose).

A 0.5% strength by weight aqueous stock suspension was prepared from 100% mixed wastepaper. The pH of the suspension was 7.1 and the freeness of the stock was 50° Schopper-Riegler (° SR).

The treated nanocellulose suspension is added to the wastepaper stock with stirring. The metered amount of treated nanocellulose (solid), based on wastepaper stock (solid), was 5%. Sheets having a basis weight of 120 g/m$^2$ were then produced from the treated wastepaper stock on a Rapid-Köthen sheet former according to ISO 5269/2. The sheets were dried by means of contact on one side with a stream-heated metal cylinder for 7 minutes at 90° C.

Example 3

200 ml of a 10% strength nanocellulose suspension were initially taken at room temperature. 0.5% by weight of the cationic polymer A (solid polymer, based on dry nanocellulose) was added thereto.

A 0.5% strength by weight aqueous stock suspension was prepared from 100% mixed wastepaper. The pH of the suspension was 7.1 and the freeness of the stock was 50° Schopper-Riegler (° SR).

The treated nanocellulose suspension was added to the wastepaper stock with stirring. The metered amount of treated nanocellulose (solid), based on wastepaper stock (solid), was 5%. Sheets having a basis weight of 120 g/m$^2$ were then produced from the treated wastepaper stock on a Rapid-Köthen sheet former according to ISO 5269/2. The sheets were dried by means of contact on one side with a stream-heated metal cylinder for 7 minutes at 90° C.

Comparative Example 1

A 0.5% strength by weight aqueous stock suspension was prepared from 100% mixed wastepaper. The pH of the suspension was 7.1 and the freeness of the stock was 50° Schopper-Riegler (° SR). Sheets having a basis weight of 120 g/m$^2$ were produced from the untreated wastepaper stock on a Rapid-Köthen sheet former according to ISO 5269/2. The sheets were dried by means of contact on one side with a steam-heated metal cylinder for 7 minutes at 90° C.

Comparative example 2, corresponding to the prior European application with the application number EP 09 150 237.7

A 0.5% strength by weight aqueous stock suspension was prepared from 100% mixed wastepaper. The pH of the suspension was 7.1 and the freeness of the stock was 50° Schopper-Riegler (° SR).

The cationic polymer A was added in undiluted form to this fiber suspension. The amount of polymer used, based on the fiber content, was 0.3% by weight (solid polymer). The stock pretreated with the cationic polymer was gently stirred for about 30 seconds. In another container, the dispersion of the anionic polymer B was diluted with water by the factor 10. The dilute dispersion was then added with gentle stirring to the fiber stock suspension. The amount of acrylate resin used was 5% by weight (solid polymer, based on the fiber content).

Sheets having a basis weight of 80 g/m$^2$ were produced from the pretreated fiber on a Rapid-Köthen sheet former according to ISO 5269/2. The sheets were dried by means of contact on one side with a steam-heated metal cylinder for 7 minutes at 90° C.

Testing of the Paper Sheets

After the sheets produced according to the examples and comparative examples had been stored for 12 hours in a conditioned chamber at a constant temperature of 23° C. and 50% atmospheric humidity, in each case the dry breaking length of the sheets was determined according to DIN 54 540. The determination of the CMT value of the conditioned sheets was effected according to DIN 53 143 and that of the dry bursting pressure of the sheets was determined according to DIN 53 141. The results are stated in table 1.

TABLE 1

| Example | Dry breaking length [m] | Bursting pressure [kPa] | CMT30 [N] |
|---|---|---|---|
| 1 | 5341 | 468 | 241 |
| 2 | 5455 | 487 | 262 |
| 3 | 5245 | 449 | 235 |
| Comparative example 1 | 3412 | 289 | 162 |
| Comparative example 2 | 4611 | 403 | 211 |

I claim:

1. A process for the production of paper, board and cardboard having high dry strength, the process comprising:

metering into a paper stock an aqueous composition comprising a nanocellulose comprising cellulose fibers and a water-soluble cationic polymer comprising a polymer comprising a vinylamine unit;

draining the paper stock to obtain paper product; and drying the paper product.

2. The process according to claim 1, wherein the nanocellulose has a length dimension below 1000 μm and a fiber thickness is in a range from 50 μm to 3 nm.

3. The process according to claim 2, wherein at least 80% of the cellulose fibers of the nanocellulose have a fiber thickness in a range from 50 μm to 3 nm.

4. The process according to claim 3, wherein at least 80% of the cellulose fibers of the nanocellulose have a fiber thickness in a range from 1 μm to 5 nm.

5. The process according to claim 1, wherein the nanocellulose has a length dimension below 1000 μm, a fiber thickness in a range from 50 μm to 3 nm, and wherein the nanocellulose comprises from 5 ppm to 2% by weight of an ionic fluid, based on a total mass of the nanocellulose.

6. The process according to claim 5, wherein at least 80% of the cellulose fibers of the nanocellulose have a fiber thickness of from 50 μm to 3 nm and comprise from 5 ppm to 2% by weight of an ionic liquid, based on a total mass of the nanocellulose.

7. The process according to claim 1, wherein a molar mass $M_w$ of the cationic polymer is in a range from 5000 to 5 million g/mol.

8. The process according to claim 1, wherein a charge density of the cationic polymer is in a range from 0.5 to 23 meq/g.

* * * * *